United States Patent [19]

Johnson et al.

[11] 4,102,953

[45] Jul. 25, 1978

[54] METHOD FOR MAKING EXTRUDED, SOLVENTLESS, COMPOSITE-MODIFIED DOUBLE BASE PROPELLANT

[75] Inventors: Craig E. Johnson, Indian Head; Paul F. Dendor, Temple Hills; Elmer R. Csanady, Forest Heights, all of Md.

[73] Assignee: The United States of America as represented by the Secretary of the Navy, Washington, D.C.

[21] Appl. No.: 689,763

[22] Filed: May 25, 1976

[51] Int. Cl.[2] ..... C06B 21/00

[52] U.S. Cl. ..... 264/3 B; 149/19.8; 149/19.92

[58] Field of Search ..... 264/3 B, 3 C; 149/19.8, 149/19.7, 19.92, 96, 19.93

[56] References Cited

U.S. PATENT DOCUMENTS

| | | | |
|---|---|---|---|
| 3,639,183 | 2/1972 | Crescenzo et al. | 149/19.8 |
| 3,689,331 | 9/1972 | Pierce | 149/97 X |
| 3,723,207 | 3/1973 | Camp | 149/96 X |
| 3,767,489 | 10/1973 | Reinhart et al. | 149/18 |
| 3,951,706 | 4/1976 | Eldridge | 149/19.8 |
| 4,000,025 | 12/1976 | Johnson et al. | 149/19.92 X |

*Primary Examiner*—Edward A. Miller

*Attorney, Agent, or Firm*—R. S. Sciascia; A. L. Branning; H. B. Field

[57] ABSTRACT

Solids loaded, extrudable, solventless, double-base propellants are formulated by combining liquid plasticizers, solid binders, a high percentage of solid oxidizers, and fillers to yield propellants having high densities and capable of delivering high specific impulse.

19 Claims, No Drawings

METHOD FOR MAKING EXTRUDED, SOLVENTLESS, COMPOSITE-MODIFIED DOUBLE BASE PROPELLANT

BACKGROUND OF THE INVENTION

The present invention relates to propellants and more specifically to solids loaded, extrudable, solventless, doublebase propellants.

Solid propellants are generally classified as being either homogeneous or composite. The former refers to those types, usually containing nitrocellulose, which are considered true monopropellants, each molecule containing all the necessary fuel and oxygen for combustion. The composite type propellant, in contrast, consists of a physical mixture of a fuel and an oxidizer.

The homogeneous nitrocellulose propellants are further subclassified as being either single, or double base, depending on whether the composition contains nitrocellulose as the sole combustible or contains additional nitroxy compounds, such as nitroglycerin, as a second combustible. Additionally, additives or fillers such as plasticizers, represented by phthalates and and triacetin; stablizers, represented by 2-nitrodiphenylamine, tertiary butylcatechol and ethyl centralite; burning rate modifiers, such as lead salts; extrusion lubricants, represented by stearates, soaps and waxes; and flash suppressors, such as potassium salts are incorporated into the propellant to help meet different ballistic requirements.

More recently, small percentages of additional oxidizers such as ammonium perchlorate and HMX have been added to the standard double-base propellant. These new propellants are termed either solids loaded double-base or composite-modified double-base propellants.

There are at least two methods presently available for producing these types of propellants; the "solvent" and the "solventless" techniques. In the "solvent" process, solvents such as acetone or ether-alcohol mixtures are used to dissolve and colloid nitrocellulose to form a viscous or doughy mass. The mass is granulated, usually by extrusion, and the volatile solvent is recovered as completely as possible. Although the "solvent" process produces a product of fair mechanical strength, difficulties are encountered in obtaining good ballistic properties. The "solventless" process avoids these limitations by eliminating entirely the need for volatile solvents to colloid the nitrocellulose. According to this process, nitrocellulose is slurried in a nonsolvent to form a paste-like mixture which is dried and rolled on hot rolls. The resulting colloided sheet is extruded or cut into the desired granulation. Although the product produced by the "solventless" process is generally characterized by good ballistic properties, it is nevertheless generally inadequate for those missile systems requiring a greater degree of mechanical strength. Previous attempts at strengthening "solventless" propellants have proved generally ineffective since they have concentrated on variations of ingredients and proportions which resulted in serious changes in ballistic parameters and workability.

SUMMARY OF THE INVENTION

Accordingly, the present invention provides a method for formulating an extrudable, solventless, double-base propellant having an appreciable quantity of ballistic solids, as well as the high specific impulse high density propellent resulting therefrom.

OBJECTS OF THE INVENTION

Therefore, it is an object of the present invention to provide a new series of propellants that can be extruded using standard solventless presses.

It is another object of the present invention to provide an extrudable solventless double-base propellant with a high percentage of solid oxidizer.

It is yet another object of the present invention to provide an extrudable solventless double-base propellant which has a high specific impulse.

Still a further object of the present invention is to provide an extrudable solventless double-base propellant which has a relatively high density.

Yet another object of the present invention is to provide the method for making solids loaded, extrudable, solventless, double-base propellants.

Other objects and many of the attendant advantages of this invention will be readily appreciated as the same becomes better understood by reference to the following detailed description.

DESCRIPTION OF THE PREFERRED EMBODIMENTS

Solids loaded, extrudable, solventless, double-base propellants, also known as composite-modified double-base propellants are formulated by combining liquid plasticizers, solid binders, a high percentage of solid oxidizers, and fillers. Initially, an equilibrium saturation solution of a liquid aliphatic hydrocarbon solvent and solutes of soluble and partially soluble liquid plasticizers and fillers is prepared. It is important to recognize that some of the solutes are completely soluble in the liquid aliphatic hydrocarbon solvent while other solutes are only partially soluble. Additionally, it must be recognized that during the processing of this propellant some of the solutes will be partially extracted from the solution while other solutes will be extracted from the propellant mix and go into solution. Thus, the final solution decanted from the undried and uncured propellant composition will have either the desired equilibrium saturation or it will be close to the desired solution depending on the condition of the initial solvent.

There are basically three ways to prepare the equilibrium solution. In the first method, a virgin liquid aliphatic hydrocarbon is used and it is run through the entire process. At the completion of the first run the intermediate solution is decanted from the propellant, the propellant is discarded, and the intermediate solution is saved. This intermediate solution is then run through the entire process a second time. As before, the propellant is discarded but this time the solution decanted at the end of the process contains the proper equilibrium concentrations and it is saved for future use.

The second method which can be used in the preparation of the first equilibrium solution is merely estimating the precentages of the various solutes which will utimately be found in the final liquid aliphatic hydrocarbon solution, adding those amounts of liquid plasticizers and fillers to the solvent and mixing these ingredients with the solvent until they are all fully dissolved.

The third method, and that which is generally preferred, starts by using the estimation method, described above, and then uses that solution in place of the intermediate solution of method one.

Although most any liquid aliphatic hydrocarbon will work well in this process, those of heptane, hexane, and octane are preferred, and heptane is most preferred.

The soluble and partially soluble liquid plasticizers and fillers which will ultimately be found in the equilibrium solution are only limited by those used in preparing the desired solids loaded propellant. Therefore, if a propellant having metriol trinitrate, thiethylene glycol dinitrate, dinormal propyl adipate and ethyl centralite is desired, they should be first dissolved in the liquid aliphatic hydrocarbon. The percentage of each ingredient to be dissolved in the solvent will vary depending on the desired propellant and thus the only way to determine the amount to be initially dissolved will be through experience.

Once the equilibrium solution has been readied, the solid binder ingredient is mixed into the solution so as to form a first slurry and deagglomerate and bruise the surface of the solid binder ingredient. Proper mixing breaks large clumps of binder so as to subsequently allow the plasticizer to evenly coat and penetrate the binder. Mixing times and rates vary broadly and depend in many cases on the type of mixing system used. However, it has been found that a good slurry will be formed if the ingredients are mixed for between about 30 and about 60 minutes at between about 3500 and 5000 revolutions per minute. The preferred mixing conditions for preparing this first slurry are about a 30 minute mixing time at about 4000 revolutions per minute.

Solids binders may range from about 10 to about 40 total weight percent of the propellant although a range from about 15 to about 30 total weight perecent is preferred. Appropriate solids binders may be, from 12–14.14 percent nitrogen nitrocellulose,.

Mixed into this first slurry is a first portion of a plasticizer. Depending on the desired propellant composition various plasticizers such as metriol trinitrate, triethylene glycol dinitrate, nitroglycerin, and pentaerythritol trinitrate may be used. However, a relatively non-active plasticizer such as metriol trinitrate is preferred. The object of this is to evenly coat the slurried solid binder ingredient with the plasticizer, and thereby prepare it for drying. A ratio which ranges from about one part plasticizer to about five parts binder to about a ratio of about one part plasticizer to about three parts binder is considered functional, however, a ratio of about one part plasticizer to about 4 parts binder is preferred. Mixing should take between about 15 and 30 minutes at between about 1000 and about 3000 revolutions per minute. The preferred mixing conditions are about 15 minutes at a rate of about 2000 revolutions per minute.

After obtaining the evenly coated slurried solid binder, the excess liquid aliphatic hydrocarbon solution is then separated from the solid binder and saved for future use. The plasticizer coated solid binder is then thoroughly dried to remove all traces of water and make it relatively non-sensative to static electric charges. Although the preferred drying conditions are about 24 hours at about 140° F, actual times and temperature may vary from about 24 to about 72 hours and from about 120 to about 140° F.

The dry coated solid binder is now ready for re-slurrying in a mixture of the previously saved liquid aliphatic hydrocarbon solution and enough liquid aliphatic hydrocarbon to replace that lost during decanting and drying. To properly re-slurry, mixing will range from about 10 to about 30 minutes at about 2000 to about 4000 revolutions per minute. Preferred mixing conditions for this step are 10 minutes at 2000 revolutions per minute.

After formation of the second slurry, a solid oxidizer is added to the slurry while mixing at about 2000 revolutions per minute. Mixing is then continued until a good dispersion is obtained. This should take about 30 minutes at about 4000 revolutions per minute. Actual mixing times and rates may however range from about 20 to about 60 minutes at about 3500 to about 5000 revolutions per minute. It is important to carefully mix the oxidizer into the slurry to insure that a good dispersion is obtained.

Solid oxidizers can vary from about 10 to about 75 total weight percent, however a range from about 40 to about 60 total weight percent is preferred. These oxidizers include nitroguanidine, ammonium perchlorate, ammonium nitrate, hydroxylammonium nitrate, hydroxylammonium perchlorate, cyclotetramethylenetetranitramine and cyclotrimethylenetrinitramine. A preferred group of solid oxidizers includes ammonium perchlorate and ammonium nitrate.

After achieving a complete dispersion of solid oxidizers in the slurry, the remaining plasticizer and fillers are mixed into the propellant system. The specific mixing conditions will vary according to the desired propellant, but a mixing time ranging from about 40 to about 100 minutes at about 3500 to about 5000 revolutions per minute will satisfy most requirements. The preferred conditions are about 40 minutes at about 4000 revolutions per minute. Depending upon the specific ballistic and tensile requirements, almost any common liquid plasticizers and fillers in almost any combination may be added. The plasticizers may be metriol trinitrate, triethylene glycol dinitrate, nitroglycerin, pentaerythritol trinitrate, dinormal propyl adipate, dibutyl phthalate, dimethyl phthalate, diethyl phthalate, dioctyl phthalate, diisobutyl azelate, dimethyl sebacate, dibutyl sebacate and mixtures thereof. The fillers may be any one or any combination of ballistic additives used in the art, however those of candelilla wax, ethyl centralite, resorcinol, 2-nitro diphenyl amine, aluminum, lead oxide, lead stamate, lead salicylate, lead $\beta$ resorcylate, copper salicylate, copper $\beta$ resorcylate and and mixtures thereof are preferred. Fillers can vary from greater than 0 to about 15 total weight percent although a range of about 0.1 to about 5 total weight percent is preferred. As these plasticizers and fillers are mixed into the propellant system they coat the solid oxidizer and begin to penetrate the coated binder. If insufficiently mixed, the coated solid binder and solid oxidizer will not receive an even coating of plasticizer and fillers, and undesirable ballistic and physical properties may result.

After throughly mixing all propellant ingredients the excess liquid aliphatic hydrocarbon solution is decanted from the wet propellant and saved for future use. The propellant is then dried and cured until the binder is fully plasticized and the mix is extruded into strands.

By way of example not by limitation the following process and formulations are given.

In a Cowles 5VTV dissolver, 1.54 pounds of dibutyl phthalate, 0.94 pounds of metriol trinitrate (MTN), 0.20 pound of Ethyl Centralite (EC), 0.10 pound of Triethylene glycol dinitrate (TEGDN), and 48.0 pounds of pure heptane are mixed for 5 minutes at 2000 RPM. To this is added 3.83 pounds of water-wet, 12.0%N nitrocellulose and this combination is mixed for 30 minutes at 4000 RPM; then 0.83 pound of MTN is added and mixing is continued for 15 minutes at 2000 RPM. The heptane is decanted and saved. The plasticizer coated NC is dried one day at 140° F. The dried coated NC, used heptane and 7.6 pounds of new heptane is mixed for ten minutes at 2000 RPM in the Cowles 5VTV mixer. While the mixer is still operating, 4.8 pounds of ammonium perchlorate (AP) is added and mixed for 10 minutes at 2000 RPM and 30 minutes at 4000 RPM. Still while the mixer is in operation, a mixture of 2.53 pounds of MTN, 0.228 pound of TEGDN, 0.18 pound of EC, 0.26 pound of resorcinol, 20 grams of candelilla wax and 0.60 pound of dibutyl phthalate are added slowly. The mix is continued for 40 minutes at 4000 RPM. The heptane is then decanted for use in another mix and the mix is dried for 4 days at ambient temperature, 1 day at 120° F, 3 days at 140° F and 1 day at 170° F. The mix is then extruded into ¼ inch strands.

Other formulations include:

| | I | II | III |
|---|---|---|---|
| (12.0%N)NC | 16.2% | 21.3% | 26.4% |
| MTN | 18.5% | 22.3% | 26.0% |
| TEGDN | 1.7% | 3.1% | 4.5% |
| Dinormal propyl adipate | 1.0% | 1.0% | 1.0% |
| EC | 2.0% | 1.7% | 1.5% |
| Resorcinol | 0.5% | 0.5% | 0.5% |
| Candelilla Wax | 0.1% | 0.1% | 0.1% |
| AP | 60.0% | 50.0% | 40.0% |

Thus it is apparent that there is provided by this invention a solid loaded, extrudable, solventless, double-base propellant having a high percentage of solids and the method of making this propellant.

It is to be understood that what has been described is merely illustrative of the principles of the invention and that numerous arrangements in accordance with this invention may be devised by one skilled in the art without departing from the spirit and scope thereof.

What is new and described to be secured by Letters Patent of the United States is:

1. A method for formulating an extrudable composite-modified double-base propellant having an appreciable quantity of ballistic solids, which comprise the steps of:

preparing a first solution comprising a liquid aliphatic hydrocarbon solvent selected from the group consisting of heptane, hexane, and octane, a first portion of active plasticizers selected from the group consisting of nitroglycerin, metroil trinitrate, triethylene glycol dinitrate, pentaerythritol trinitrate and mixtures thereof, a first portion of relatively non-active plasticizers selected from the group consisting of dinormal propyl adipate, dibutyl phthalate, dimethyl phthalate, diethyl phthalate, dioctyl phthalate, diisobutyl azelate, dimethyl sebacate, dibutyl sebacate, and mixtures thereof, and a first portion of filler ingredients selected from the group consisting of ethyl centralite, resorcinol, candelilla wax, 2-nitro diphenyl amine, aluminum lead oxide, lead stamate, lead salicylate, copper salicylate, lead $\beta$ resorcylate, copper $\beta$ resorcylate, and mixtures thereof;

mixing a solid binder ingredient selected from the group consisting of from 12 to 14.14% nitrogen nitrocellulose, into said first solution so as to form a first slurry;

agitating said first slurry for from about 30 to about 60 minutes at a rate from about 3500 to about 5000 revolutions per minute, so as to deagglomerate and bruise the surface of the selected solid binder ingredient;

mixing into said first slurry a second portion of the selected relatively non-active plasticizers so as to coat said deagglomerated solid binder ingredient;

separating and saving said first liquid aliphatic hydrocarbon solution from said coated solid binder;

drying said coated solid binder to remove any remaining liquid aliphatic hydrocarbon and any traces of water;

determining the amount of the selected liquid aliphatic hydrocarbon lost in separating and drying;

forming a second slurry by re-slurrying said dry coated solid binder in a second solution comprising a mixture of said saved solution and enough of the selected liquid aliphatic hydrocarbon to replace that lost in separating and drying;

mixing a solid oxidizer selected from group consisting of nitroquanidine, ammonium perchlorate, ammonium nitrate, cyclotetramethylenetetranitramine, and cyclotrimethylenetrinitramine into said second slurry to obtain a uniform dispersion of said solid oxidizer and said coated solid binder;

forming a solid composition by mixing into said dispersion a second portion of the selected active plasticizer ingredients and the selected fillers, and a third portion of the selected relatively non-active plastizers, so as to evenly coat said solid oxidizer and begin to penetrate said coated solid binder;

separating and saving the resulting liquid aliphatic hydrocarbon solution from said solid composition;

drying and curing said solid composition until it is fully plasticized; and extruding the dried cured composite-modified double-base propellant composition.

2. The method of claim 1 wherein said first solution is prepared by estimating the weight percents of the selected active and relatively non-active plasticizer ingredients and fillers which will be found in said second liquid aliphatic hydrocarbon solution and then mixing those ingredients in their proper percentages into said liquid aliphatic hydrocarbon solvent.

3. The method of claim 1 wherein the process for preparing said first solution, comprises the steps of:

estimating the weight percents of the selected active and relatively non-active plasticizer ingredients and fillers which will be found in said second liquid aliphatic hydrocarbon solution;

mixing said active and relatively non-active plasticizers and fillers in their estimated percentages with the selected liquid aliphatic hydrocarbon solvent, to make a presaturated equilibrium solution;

mixing a solid binder ingredient into said presaturated equilibrium solution, so as to form a slurry;

agitating said slurry for from about 30 to about 60 minutes at a rate from about 3500 to about 5000 revolutions per minute so as to deagglomerate and bruise the surface of said solid binder ingredient;

mixing into said slurry a relatively non-active plasticizer to coat said deagglomerated solid binder ingredient;

separating and saving said presaturated equilibrium liquid aliphatic hydrocarbon solution from said coated binder;

drying said coated binder to remove any remaining liquid aliphatic hydrocarbon and any traces of water;

determining the amount of liquid aliphatic hydrocarbon lost in said separating and drying;

forming a second slurry by re-slurrying said dry coated binder in a second solution comprising a mixture of said presaturated equilibrium solution and enough of the selected liquid aliphatic hydrocarbon to replace that lost separating and drying;

mixing a solid oxidizer selected from the group consisting of nitroguanidine, ammonium perchlorate, ammonium nitrate, cyclotetramethylenetetranitramine, and cyclotrimethylenetrinitramine into said second slurry so as to obtain a uniform dispersion of solid oxidizer and said coated solid binder;

mixing into said dispersion all remaining plasticizer ingredients and fillers; and separating and saving the resulting liquid aliphatic hydrocarbon solution.

4. The method of claim 1 wherein said liquid aliphatic hydrocarbon is heptane.

5. The method of claim 1 wherein said first solution is prepared by mixing the selected plasticizer ingredients with the selected liquid aliphatic hydrocarbon for from about 5 to about 15 minutes at about 1000 to about 4000 revolutions per minute.

6. The method of claim 5 wherein the selected plasticizer ingredients are mixed with the selected liquid aliphatic hydrocarbon for about 5 minutes at about 2000 revolutions per minute.

7. The method of claim 1 wherein said deagglomerating and bruising is effected by mixing for about about 30 minutes at about 4000 revolutions per minute.

8. The method of claim 1 wherein the second portion of the selected relatively non-active plasticizers are mixed with said first slurry for about 15 to about 30 minutes at a rate of from about 1000 to 3000 revolutions per minute.

9. The method of claim 8 wherein said mixing is for about 15 minutes at about 2000 revolutions per minute.

10. The method of claim 1 wherein said drying of said coated binder takes from about 24 to about 72 hours at about 120° to about 140° F.

11. The method of claim 10 wherein said initial drying takes about 24 hours at about 140° F.

12. The method of claim 1 wherein said re-slurrying is effected by mixing said dry coated binder with said first solution and an additional amount of the selected liquid aliphatic hydrocarbon for from about 10 to about 30 minutes at about 2000 to about 4000 revolutions per minute.

13. The method of claim 12 wherein said mixing is for about 10 minutes at about 2000 revolutions per minute.

14. The method of claim 1 wherein the selected solid oxidizer is mixed into said second slurry for from about 5 to about 15 minutes at a rate of about 1000 to about 3000 revolutions per minute.

15. The method of claim 14 wherein the selected solid oxidizer is mixed into said second slurry for about 10 minutes at about 2000 revolutions per minute.

16. The method of claim 14 wherein said oxidizer slurry mixture is continuously mixed for about 20 to about 60 minutes at about 3500 to about 5000 revolutions per minute.

17. The method of claim 16 wherein said continuous mixing is for about 30 minutes at about 4000 revolutions per minute.

18. The method of claim 1 wherein said second portion of the selected active plasticizers, and the selected fillers, and a third portion of relatively non-active plasticizer ingredients are mixed into said dispersion for from about 40 to about 100 minutes at from 3500 to about 5000 revolutions per minute.

19. The method of claim 18 wherein said mixing is for about 40 minutes at about 4000 revolutions per minute.

* * * * *